US007914170B2

(12) United States Patent
Engel

(10) Patent No.: US 7,914,170 B2
(45) Date of Patent: Mar. 29, 2011

(54) INTERIOR LIGHT

(76) Inventor: Hartmut S. Engel, Ludwigsburg (DE)

( * ) Notice: Subject to any disclaimer, the term of this patent is extended or adjusted under 35 U.S.C. 154(b) by 318 days.

(21) Appl. No.: 11/917,260

(22) PCT Filed: Jun. 9, 2006

(86) PCT No.: PCT/EP2006/005551
§ 371 (c)(1),
(2), (4) Date: Jun. 12, 2008

(87) PCT Pub. No.: WO2006/133861
PCT Pub. Date: Dec. 21, 2006

(65) Prior Publication Data

US 2009/0225537 A1 Sep. 10, 2009

(30) Foreign Application Priority Data

Jun. 13, 2005 (EP) ..... 05012670

(51) Int. Cl.
*F21V 21/10* (2006.01)

(52) U.S. Cl. ..... 362/217.08; 362/219; 362/224; 362/225; 362/217.04; 362/217.05; 362/217.09

(58) Field of Classification Search ..... 362/260, 362/222, 223, 224, 225, 217.03, 217.04, 362/217.05, 217.07, 217.08, 217.09
See application file for complete search history.

(56) References Cited

U.S. PATENT DOCUMENTS

| | | | | |
|---|---|---|---|---|
| 4,450,513 | A * | 5/1984 | Guggemos | 362/299 |
| 4,876,633 | A * | 10/1989 | Engel | 362/223 |
| 5,343,373 | A * | 8/1994 | Tillotson | 362/221 |
| 6,092,913 | A | 7/2000 | Edwards, Jr. | |
| 7,296,910 | B2 * | 11/2007 | Mayfield et al. | 362/217.05 |
| 2002/0075675 | A1 * | 6/2002 | Yaphe et al. | 362/225 |
| 2005/0041432 | A1 | 2/2005 | McCarthy et al. | |

FOREIGN PATENT DOCUMENTS

| | | | |
|---|---|---|---|
| CA | 2 374 023 | A1 | 11/2000 |
| DE | 199 61 491 | A1 | 7/2000 |
| DE | 100 06 410 | A1 | 8/2001 |
| DE | 103 44 066 | A1 | 6/2004 |
| EP | 1 055 865 | A2 | 11/2000 |
| EP | 1 338 845 | A2 | 8/2003 |
| WO | 00/71929 | A1 | 11/2000 |
| WO | 2006/133861 | A1 | 12/2006 |

OTHER PUBLICATIONS

European Search Report relating to application No. 05 012 670.5, dated Nov. 7, 2005, 3 pages.
International Search Report related to application No. PCT/EP2006/005551, dated Aug. 9, 2006, 3 pages.
International Preliminary Examination Request related to application No. PCT/EP06/05551 dated Jun. 26, 2007.
English Translation of the International Preliminary Report on Patentability related to application No. PCT/EP2006/005551, dated Apr. 10, 2008.

* cited by examiner

*Primary Examiner* — Laura Tso
(74) *Attorney, Agent, or Firm* — Lewis and Roca LLP

(57) ABSTRACT

Disclosed is a flatly designed interior light which is essentially characterized by a centrally arranged hollow profiled support (1) that is disposed between two final parts (15) and is provided with an interior receiving space (17) and exterior reflective surfaces (18,19,20,21) for two fluorescent lamps (2, 3) which adjoin the profiled support (1) and run parallel thereto, and light guiding chambers (6, 7) that are placed on both sides of the profiled support (1), extend to the lateral border of the light, and are closed by the light emission surface (13) facing the room. Preferably, the height of the light, which reaches a maximum in the region of the central profiled support (1), decreases continuously in the direction of the edges (11) of the light until reaching approximately the thickness of the components (8, 9, 10) that form the light emission surface (13) facing the room.

23 Claims, 4 Drawing Sheets

INTERIOR LIGHT

Figure 1:
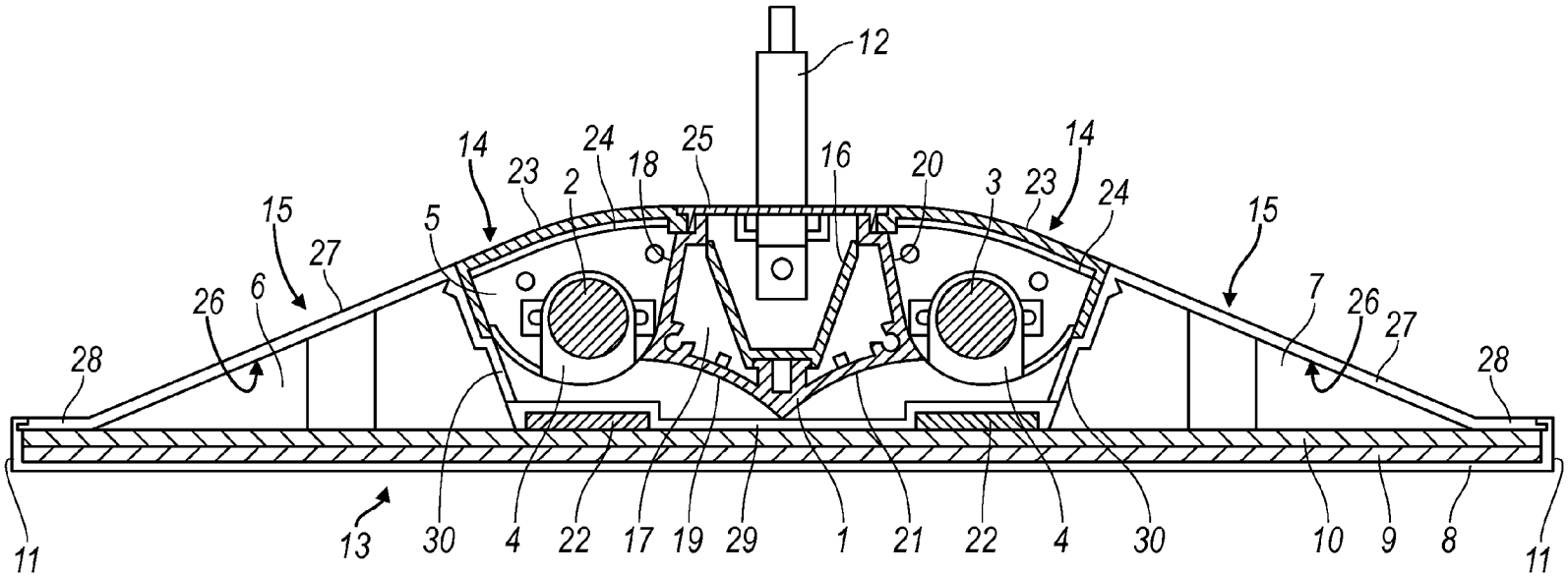

The invention relates to a light fixture, in particular to an interior light fixture in a shallow construction, having at least two fluorescent lamps which are arranged substantially with central symmetry, extend substantially over the respective length of the light fixture and are socketed at both ends as well as having light emission surfaces held in supporting housing parts and disposed at the room side and/or at the ceiling side.

Light fixtures of this type are known, for example, from EP 1 338 845 A2 and DE 199 61 491 A1.

With these known light fixtures, the fluorescent lamps are arranged in housing regions disposed at the rim side and a light radiation surface is formed between these lateral housing regions designed for the reception of the lamps at least at the room side, said light radiation surface having a specific prism design. An attempt is made by the reflectors associated with the fluorescent lamps in cooperation with the prism surface to achieve a luminance at the light radiation surface which is as uniform as possible. Despite the construction effort made in the known solutions, the achievable reduction in the construction height of the light fixture is limited by the required mounting of the fluorescent lamps in the lateral housing regions and, in addition, the achievable intensity of illumination and the luminance distribution over the light radiation surface of the light fixture leave a lot to be desired.

A light fixture of the generic type is furthermore known from DE 103 44 066 A1. This light fixture has two socket holders at the end side to which a support frame is connected at the two end faces of the light fixture, said support frame having a base and a rim raised with respect to the base. The base is made as a perforated metal sheet, with a light permeable plate lying on this perforated metal sheet within the raised rim and a light scattering film in turn being located on said plate. A reflector with planar walls and made as a polygonal hollow part is provided centrally between two fluorescent lamps extending over the length of the light fixture and an electrical ballast can be received in the interior space of said reflector. Covering walls extend between the two end face walls and first extend vertically laterally next to the fluorescent lamps and then obliquely toward the support frame. Inwardly disposed reflectors can be associated with these walls.

It is therefore above all the object of the invention to design the light fixture both under technical aspects and under esthetic aspects such that it provides an extremely shallow appearance of absolutely minimized construction height in the mounted state and such that it is simultaneously ensured that a light radiation for a high direct light portion is made available which is illuminated as uniformly as possible, which has limited glare at least at the room side and which is bounded, or partly bounded, only by narrow, strip-shaped housing regions.

This object is substantially satisfied in accordance with the invention by a hollow support section arranged centrally and between two end parts as well as having an inwardly disposed receiving space and outwardly disposed reflection surfaces for two fluorescent lamps adjacent to the support section and extending parallel thereto and light guide chambers which are provided at both sides of the support section, extend up to the side boundary of the light fixture and are closed by the light emission surface at the room side, with the maximum height of the light fixture in the region of the central support section reducing, preferably continuously, in the direction of the margins of the light fixture approximately down to the thickness of the components forming the light emission surface at the room side.

Due to the use of a centrally arranged hollow support section with a high deflection strength which is simultaneously made as a multifunctional section and has defined reflection surfaces with respect to the adjacently arranged fluorescent lamps, it is possible in conjunction with light guide chambers which reduce in height toward the marginal region of the light fixture to achieve both a minimal construction height at the rim side and to achieve a high direct light portion and a uniform light distribution over the total light emission surface at the room side.

The light emission surface at the room side which bounds the light guide chambers downwardly preferably consists in its design, seen from the room side, of a glass plate or of a corresponding plastic plate, of a prism plate with prism elements disposed at the glass side and in particular being of pyramid shape and, optionally, of an adjoining diffuser film. This light emission surface is acted on by light very uniformly over the total surface by the fluorescent lamps arranged at both sides of the hollow section through the cooperation between the reflection surfaces provided at the hollow section and the specifically designed light guide chambers while generating a high direct light portion, with diffusion strips which are arranged directly beneath the fluorescent lamps also contributing to this homogenization of the light action onto the light emission surface.

Due to the positioning of all space-requiring components in the central region of the light fixture and to the extreme reduction in the light fixture height toward to the marginal sides, the central region of the light fixture is practically always disposed in the vision shadow in the mounted condition of the light fixture, even with a lateral line of sight, so that only the light emission surface of the light fixture at the room side having the unusually narrow marginal regions is perceived, which results in an esthetically extremely pleasing, shallow appearance of the light fixture.

The centrally disposed region of maximum height in which the hollow support section is located preferably extends approximately over a quarter of the total width of the light fixture and the height of the marginal rails or the height of the frame bounding the light fixture at the marginal side amounts to less than 20% of the maximum height of the light fixture. This low marginal height is substantially set by the material thickness of the components used for the formation of the light emission surface.

The multifunctional support section made with central symmetry has a first concave reflection surface facing the respective fluorescent lamp and an adjoining second concave reflection surface. The first reflection surface is aligned such that it in particular directs light into the light guide chamber associated with it and/or to the ceiling side for the achieving of an indirect light portion, whereas the second reflection surface predominantly directs the incident light in the direction of the light emission surface at the room side or distributes it over the light emission surface.

Whereas the inner space of the hollow support section serves for the mounting of functional components such as an electric ballast, the total external surface of the support section is preferably used as a reflection surface, with the room-side end of this hollow section made as a tip being disposed directly adjacent to the room-side light emission surface to utilize all the possibilities for the minimization of the total height of the light fixture.

Since a light fixture in accordance with the invention can have a length of more than 3 m, it is of importance that the support section used has a high deflection stiffness. The desired high deflection stiffness is achieved by the selected cross-sectional shape of the section, on the one hand, and in that, on the other hand, portions of a stiffening section can be clipped into the hollow section which result in a stiffening multi-chamber structure. In addition, the upwardly open side of the support section can be closed by a strip-shaped stiffening cover so that an unusually flexurally stiff total arrangement arises overall.

The light guide chambers disposed to the side of the respective fluorescent lamp consist of transparent material and are preferably connected via a connection wall on the base side to form a single-part component.

Since the room-side direct light emission surface is both acted on by light directly by the fluorescent lamps and an indirection action also takes place via reflected light, there is the possibility of directly realizing a respectively ideal light distribution by use of reflecting and/or scattering and/or partially permeable or totally reflecting coatings or films and/or inserted or integrated linear prismatic structures, with light not only being able to be distributed uniformly via the room-side light emission surface, but a freely selectable portion of light also being able to be guided to the ceiling side.

The region disposed above the fluorescent lamps between the support section and the light guide chambers also contributes to the respectively desired light distribution, said region being closable by an at least partly light permeable cover and/or at least partly reflecting cover and/or scattering cover, with the cover being able to be combined for this purpose with correspondingly suitable films, coatings or prismatic structures. The prismatic structures preferably extending in a linear manner and transversely to the longitudinal extent of the light fixture can also be made in integrated form with the cover and can in particular be provided at the outer side.

The mounting of the respective light fixture takes place via the end parts which are provided at both ends, are screwed to the support section, carry lamp sockets and additionally ensure shape matched connections to the remaining light fixture components.

A preferred embodiment of the light fixture in accordance with the invention is characterized in that a plurality of individual modules, which are the same in themselves, are associated with a set light fixture and support section length in the form of a support frame for the components of the light emission surfaces as well as for the light guide chambers and, optionally, further cover members, with the individual modules being able to be connected to one another via stabilizing coupling elements which divide the light emission surface at the room side in the manner of transverse webs.

This modular design not only results in a particularly stable overall structure, but it is also achieved in this manner that light fixtures of different length can be built up from the individual modules, said length being set by the fluorescent lamps used and the associated support section, with the division of the modules being matched to the popular lamp lengths.

A problem-free stringing together of modules is ensured in that each support frame, which is made closed in itself, has in each case at the end face a frame web part which is sectioned and is matched at least in part to the shape of the light guide chambers and in that in each case two mutually adjacent frame web parts can be connected to one another in a shape matched and force transmitting manner via a coupling web part.

Alternatively to the use of a support frame, which is made closed in itself, in connection with the individual modules, the individual modules can also each be formed by transparent light guide chambers which are combined to form an assembly and onto which the connection web parts are shaped which are likewise transparent at the end face. Mutually adjacent modules are connected to one another using a coupling web part dividing the room-side light emission surface in the manner of a transverse web, with the coupling web part being fastened, in particular screwed, in a shape matched and force transmitting manner to the frame web parts provided at the light guide chambers. The frame web parts engage into corresponding recesses in the coupling web part to ensure the shape matched connection so that the otherwise customary coupling distance can be dispensed with. Since, moreover, the frame web parts shaped onto the light guide chambers are transparent, in this case only the coupling web parts dividing the light emission surface in the manner of transverse webs are visible as non-light permeable elements at this light emission surface at the room side.

The marginal rails can either be made as separate elements or can be shaped in one part onto the marginal side onto the light permeable plate which bounds the light emission surface at the room side. The marginal rails can also be shaped onto the light guide chambers in one part, with the components forming the light emission surface having to be inserted laterally into the marginal rails guiding these components in this case. These embodiments in particular provide the possibility of using e.g. transparent or differently colored marginal rails in the case of separate marginal rails, whereas, with marginal rails shaped on directly, they are as a rule transparent so that the light fixture does not have any non-light permeable boundary at the marginal side.

With the light fixtures anyway made in frames closed in themselves, the frame web parts to be connected to the coupling web parts are made in one part with the light guide chambers and are transparent in accordance with these chambers. In the room-side view of the light fixture, this has the result that substantially only the coupling web parts receiving the frame web parts in a shape matched manner are visible as webs dividing the light fixture in the transverse direction.

It is particularly advantageous within the framework of the invention that individual light fixtures of modular or non-modular structure can be screwed together via intermediate supports having socket holders for fluorescent lamps at both sides to provide light strip arrangements extending between two end parts, with said intermediate supports, which are preferably connected to a mounting, forming cross-webs analog to the coupling web parts of the individual modules at the light emission surface at the room side.

Light strips which have an exceptionally light effect in an esthetic aspect and with a uniform structure throughout with respect to the visible frame parts can be provided by the stringing together of individual light fixtures of modular or non-modular design made possible in this manner.

Figure 2:
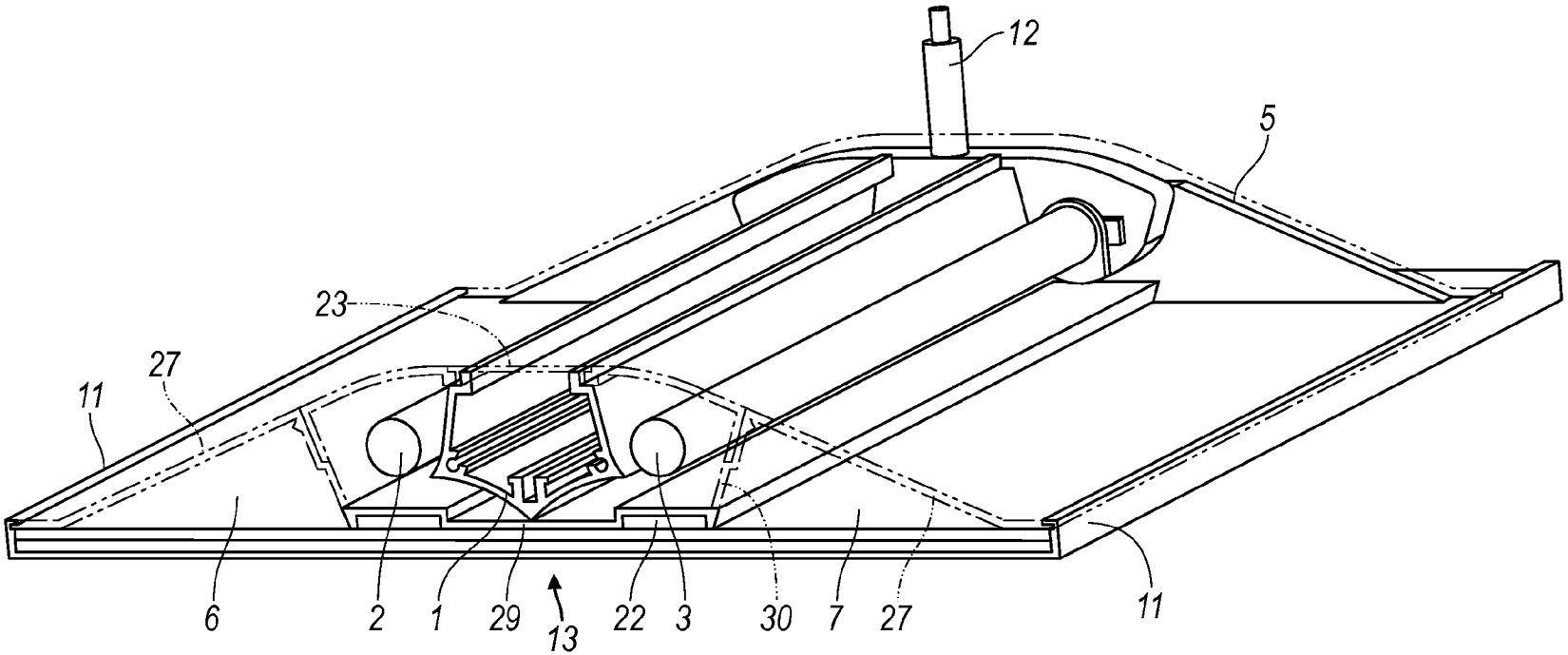
Figure 3:
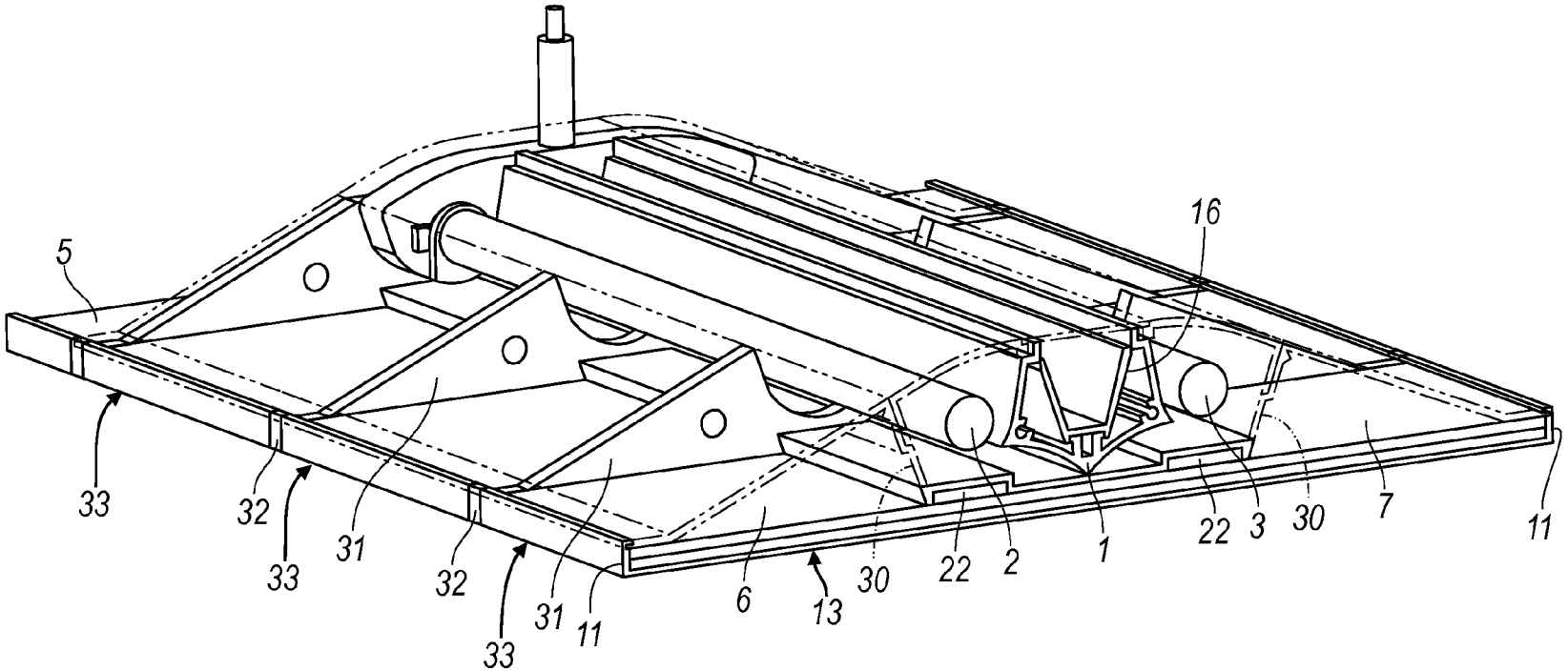
Figure 4:
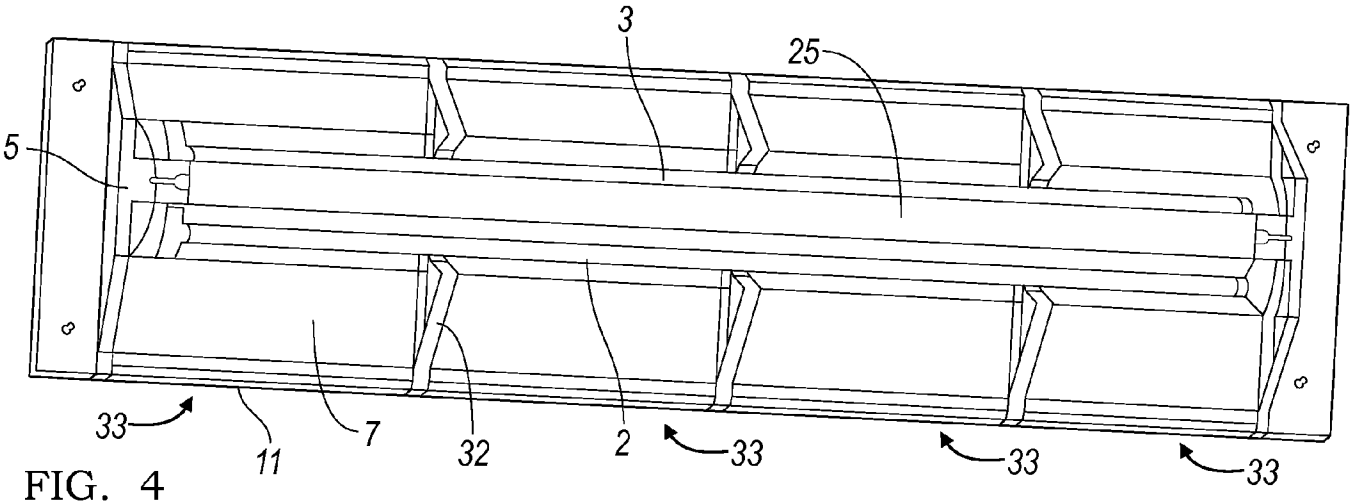
Figure 5:
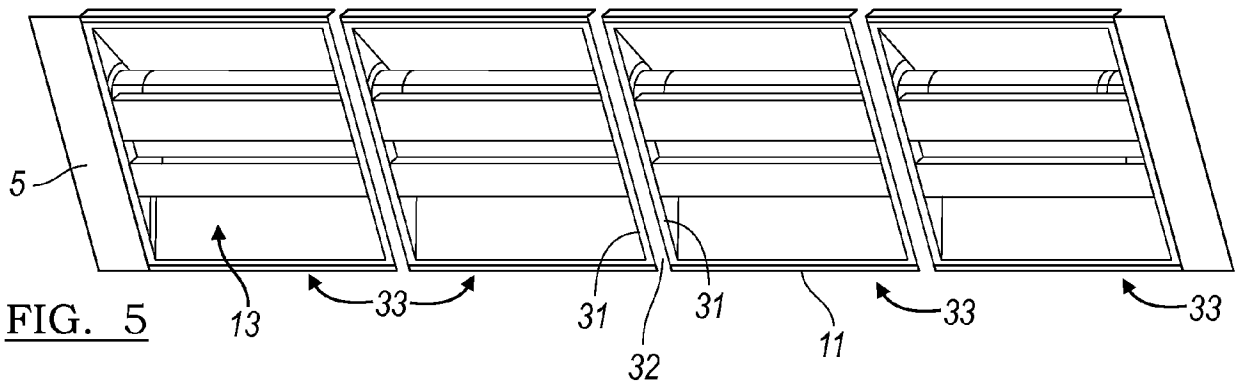

Further details of the invention will be explained in the following with reference to the description of embodiments and to the drawings; there are shown in the drawings:

FIG. 1 a schematic cross-sectional view of a light fixture in accordance with the invention;

FIG. 2 a perspective part view of a first embodiment of the invention;

FIG. 3 a perspective part view of a second embodiment of the invention with a modular structure;

FIG. 4 a ceiling-side view of the light fixture in accordance with FIG. 3; and FIG. 5 a room-side view of the light fixture in accordance with FIG. 3, with the room-side prism plate being omitted in this view.

The cross-sectional view in accordance with FIG. 1 shows a preferred embodiment of the central hollow support section 1 positioned between two fluorescent lamps 2, 3 which are mounted at both ends in sockets 4 which are attached to corresponding light fixture end parts 5. The walls of the support section 1 are made in concave form—seen from the outside—whereby the support section becomes a multifunctional section since it not only has a supporting function and, with respect to its interior space 17, a mounting function for an electrical ballast and the like, but its outer surfaces are also simultaneously used as reflection surfaces, for which purpose a corresponding coating or application of reflecting films can be provided. This embodiment as a multifunctional section ensures that this support section 1 and the associated integrated elements can be arranged between the two fluorescent lamps.

Accordingly, a first reflection surface 18 or 20, respectively adjacent to the associated fluorescent lamp 2, 3, and a second reflection surface 19 or 21 are located on each side of the support section 1 made with central symmetry. The axes of the respective first and second reflection surfaces include an angle between them, for example, of approximately 90°. The respective second reflection surfaces 19, 21 are aligned such that the light reflected by them is distributed over the light emission surface 13 disposed at the room side.

Light guide chambers 6, 7 having the shape of approximately acutely angled triangles in cross-section are located in each case to the side of the two fluorescent lamps 2, 3, said light guide chambers preferably consisting at least substantially of transparent material, permitting the selection of a settable extent of the cover wall 27 and being combined via a connection wall 29 at the base side to form a one-part component.

At the room side, a glass plate, or a correspondingly transparent plastic plate 8, a prism plate 9 and a respectively adjoining diffuser film 10 are located beneath the light guide chambers 6, 7—as well as beneath the wall 29 connecting them—seen from the room side. The prism plate 9 serves to achieve the required masking effect, with the preferably pyramid-shaped prism being disposed on the side of the glass plate and this glass plate thus simultaneously protecting the prisms from contamination and ensuring a smooth outer surface which is easy to clean.

The components 8, 9, 10 as well as the light guide chamber 6, 7, 29 are mounted in a support frame 11 whose height essential for the appearance of the light fixture is minimized and is practically only determined by the material thicknesses of the components 8, 9, 10 forming the light emission surface 13.

This support frame 11 is held in the end parts 5 and in additional coupling web parts in the case of a modular structure of the light fixture still be explained in detail.

Not only the reflection surfaces specifically provided at the support section contribute to the homogenization of the luminance and to the achieving of a high direct light portion at the room-side light emission surface 13, but also diffuser strips 22 provided directly beneath the fluorescent tubes 2, 3 in corresponding recesses of the connection wall 29 as well as reflection surfaces and/or prism surfaces 26 provided either at the inner side or at the outer side as required at the cover wall 27 of the light guide chambers 6, 7 or at the cover 23, with the prism surfaces preferably having a linear structure and the linear prism elements extending transversely to the longitudinal direction of the light fixture. The prisms, which can also be integrated into the respective light permeable element, are outwardly directed and are covered by a suitable cover surface so that a smooth surface is always present which outwardly protects against contamination and which can also be cleaned without problem. Reversing prismatic films can specifically be used in this connection, but it is also possible to make the prisms in integrated manner with the respective transparent walls or wall regions instead of using corresponding films.

The portion of the indirect light directed to the ceiling can be influenced by the selection of the light permeability of the cover wall 27 of the light guide chambers 6, 7 and equally by the selection of a more or less light permeable cover 23 or also a reflecting cover above the fluorescent lamps 2, 3. For this purpose, a suitable film 24 or prismatic film or an integrated prismatic structure can be provided at the inner side of this cover 23 so that the ceiling-side light emission surfaces 14, 15 desired in the individual case can be obtained.

The mounting of the light fixture takes place via mounting means 12 which preferably cooperate with cables and which can be connected to the end parts 5.

It has already been pointed out that a high deflection stiffness is required with respect to the support section 1, since light fixtures with a length of several meters can be realized and thoroughgoing hollow sections of a length corresponding thereto are required. To increase the deflection stiffness, portions of a stiffening section 16 can be snapped into the hollow section 1 and result in conjunction with a stiffening cover 25 likewise made able to be snapped into a multi-chamber structure of the section which is characterized by a particularly high stiffness.

It can also be seen from FIG. 1, which is an image of a specifically designed light fixture in accordance with the invention which is true to scale with respect to the relative dimensions, that the centrally disposed region of maximum height extends approximately over a quarter of the total width of the light fixture and that the height of the frame 11 at the marginal side amounts to less than 20% of the maximum light fixture height. It is still of importance with respect to the advantages achieved by these dimensional relationships that the cover wall 27 of the light guide chambers 6, 7 merges laterally into a marginal rails 28 which lies on the components of the light emission surface 13.

This also contributes to the fact that with a mounted light fixture and under the customary angles of observation only the light emission surface 19 and the support frame 11 of very low height are visible, whereas the total structure disposed thereabove lies in the vision shadow and the centrally disposed functional components of the light fixture thus do not have a disturbing appearance.

The perspective part view in accordance with FIG. 2 shows an embodiment of the invention in which the components already explained with reference to FIG. 1 are used and in which in particular the light permeable walls 27, 30 of the light guide chambers 6, 7 also extend over the total length of the light fixture. The marginal rails 11, which can consist of transparent or differently colored material, are fixedly connected to the end parts 5 and receive the areal components forming the light emission surface 13 as well as the marginal region of the cover wall 27 of the light guide chambers 6, 7.

A particularly advantageous embodiment of the invention can be seen in the perspective part view of FIG. 3. This is an embodiment in which the light fixture is made up in a modular manner of parts which are identical to one another.

A hollow support section 1 of the already described kind which is thoroughgoing over the length of the light fixture and extends between two end parts 5 is also used in this embodiment. The light fixture structure consists, however, of a plurality of identical individual modules 33. The individual modules 33 can be designed in different manners in this connection. In accordance with a first embodiment, an individual module 33 in each case includes a support frame 11, closed in itself, for the components of the light emission surface 13 as well as for the light directing chambers 6, 7 again preferably combined to form a unit. Each of the support frames 11 made closed in themselves in this case has, at the end face, a respective sectioned frame web part 31 which is approximately matched to the light guide chambers 6, 7. In the design of the light fixture, in each case two mutually adjacent frame web parts 31 of adjacent modules 33 are connected to one another in a shape matched and force transmitting manner via a coupling web part 32, with a very stable total arrangement arising overall. The frame web parts 31 and the coupling web part 32 respectively disposed therebetween are visible at the light emission surface 13 at the room side and thus structure this light emission surface 13 together with the outwardly disposed marginal frame rails. The degree of visibility of the frame web parts 31 can be preset by the engagement depth of the frame web parts into the coupling web parts 32 receiving them in a shape matched manner.

In accordance with a modified and simplified embodiment variant, the frame web parts are shaped in one part onto the end faces of the light directing chambers 6, 7 and are likewise made transparent. The connection of the individual modules to one another takes place in turn in each case via a coupling web part which can again be connected in a shape matched and force transmitting manner to the frame web parts of sequential modules.

If the marginal rails required for the holding of the components forming the light emission surface at the room side are not shaped directly onto the assembly including the light guide chambers or if these marginal rails are not shaped onto the light permeable plate bounding the light emission surface at the room side, in particular marginal rails of different materials and of different colors can be used, with in this case the visible surface of the light fixture at the room side only being structured by the marginal rails and by the coupling web parts since the transparent frame web parts made in once piece with the light directing chambers are not visible or are only negligibly visible.

In accordance with a further embodiment, the marginal rails can be shaped in one piece onto the transparent plate of the light emission surface disposed at the room side so that a light emission surface results which is only structurally divided by the transverse webs originating from the coupling web parts.

FIG. 4 shows a view of a light fixture having the basic structure of FIG. 3 from the ceiling side, whereas FIG. 5 shows a view of this light fixture from the room side without a prismatic surface 9 at the room side and allows the desired formal division of the light emission surface 13 by the transverse webs 31, 32 to be recognized.

In specific applications, in particular in correspondingly large rooms, so-called light strip arrangements are frequently required and such light strip arrangements can be provided in a particularly simple and effective manner starting from the light fixture in accordance with the invention in that individual light fixtures of a modular or non-modular form can be screwed together practically without a seam via intermediate supports having socket holders for fluorescent lamps at both sides without the otherwise usual coupling distance, with these intermediate supports preferably connected to a mount forming transverse webs analog to the double web parts of the individual modules at the light emission surface at the room side.

Formally and structurally uniform and also large-area light strips are realized in this manner which are distinguished both in a technical light aspect due to the achievable high and uniform luminance and in an esthetic aspect due to their extremely shallow appearance.

REFERENCE NUMERAL LIST

1 hollow support section
2 fluorescent lamp
3 fluorescent lamp
4 sockets
5 end part
6 light guide chamber
7 light guide chamber
8 glass plate
9 prism plate
10 diffuser film
11 support frame, marginal rail
12 mount
13 light emission surface for direct light
14 light emergence surface for indirect light
15 light emergence surface for indirect light
16 stiffening section
17 receiving space
18 first reflection surface
19 second reflection surface
20 first reflection surface
21 second reflection surface
22 diffuser strip
23 light permeable cover
24 film or prismatic structure
25 stiffening cover
26 reflector surface or prism surface
27 cover wall, transparent
28 marginal strip
29 connection wall, transparent
30 inner wall, transparent
31 frame web part, connection web part
32 coupling web part
33 individual module

The invention claimed is:

1. A light fixture having at least two fluorescent lamps socketed at both ends and arranged with central symmetry extending substantially over the respective length of the light fixture and having light emission surfaces held in supporting housing parts and disposed at at least one of a room side and at a ceiling side, comprising:

a hollow support section arranged centrally and between two end parts and having an inwardly disposed receiving space and outwardly disposed concave reflection surfaces for the fluorescent lamps adjacent to the hollow support section and extending parallel thereto, the hollow support section having a high deflection stiffness and;

light guide chambers disposed at both sides of the support section, the light guide chambers bounded by walls at the ceiling side, by inner walls extending therefrom to the light emission surface at the room side and closed by the light emission surface at the room side, the light guide chambers connected via a connection wall at the base side to form a one-part assembly, and wherein the maximum height of the light fixture in the region of the central hollow support section reduces over the walls of the light guide chambers at the ceiling side in the direction of the light fixture margins approximately down to the thickness of the light permeable components forming the light emission surface at the room side.

2. A light fixture in accordance with claim 1, characterized in that the centrally disposed region of maximum height extends approximately over a quarter of the total width of the light fixture.

3. A light fixture in accordance with claim 1, characterized in that the components forming the light emission surface at the room side are mounted at the marginal side in a frame or in marginal rails whose height is less than 20% of the maximum height of the light fixture.

4. A light fixture in accordance with claim 1, characterized in that a cover wall of each light guide chamber merges into a marginal strip contacting the components of the light emission surface whose width is larger than the height of the frame or of the corresponding marginal rails.

5. A light fixture in accordance with claim 1, characterized in that the support section has at the lamp side a first concave reflection surface and a second adjoining concave reflection surface, the first reflection surface oriented to direct light into at least one of the light guide chamber associated with it and to the ceiling side and the second reflection surface oriented to direct light in the direction of the light emission surface at the room side.

6. A light fixture in accordance with claim 5, characterized in that the respective second reflection surfaces are mutually adjacent at a lower tip of the hollow section, the lower tip of the hollow section being disposed directly adjacent to the components forming the light emission surface at the room side.

7. A light fixture in accordance with claim 1, characterized in that portions of a stiffening section are latchable to the inner space of the support section to increase the twist stiffness of the support section.

8. A light fixture in accordance with claim 1, characterized in that a respective mount for a diffuser strip is provided in the region beneath the fluorescent lamp tubes in the connection wall at the base side.

9. A light fixture in accordance with claim 1, characterized in that the walls of the light guide chambers and the connection wall are formed from a light permeable material.

10. A light fixture in accordance with claim 1, characterized in that the region disposed above the fluorescent lamps between the support section and the light guide chambers is closed by one of an least partly light permeable, an at least partly reflecting, and a scattering cover.

11. A light fixture in accordance with claim 1, characterized in that the components forming the light emission surface at the room side include one of a glass plate, a transparent plastic plate, a prism plate having prismatic elements disposed on the side thereof.

12. A light fixture in accordance with claim 1, characterized in that the end parts are mechanically coupled to the support section and to mounting means and have holding and fastening elements for lamp sockets, the light guide chambers and frames or marginal rails for the mounting of the components forming the light emission surface at the room side.

13. A light fixture in accordance with claim 1, characterized in that a plurality of identical individual modules are associated with a set lamp and support section length in the form of a support frame for the components of the light emission surfaces, for the light directing chambers and cover members, the individual modules being connectable to one another via stabilizing coupling elements in the form of transverse webs which divide the light emission surface at the room side.

14. A light fixture in accordance with claim 13, characterized in that each support frame has at the end face a sectioned frame web part matched to the shape of the light guide chambers and two mutually adjacent frame web parts are connectable to one another in a shape matched and force transmitting manner via a coupling web part.

15. A light fixture in accordance with claim 1, characterized in that a plurality of identical individual modules are associated with a set lamp length and support section length and are formed by an assembly containing the light guide chambers and formed from transparent material with connection web parts at the end face, by a coupling web part connectable to two mutually adjacent connection web parts in a shape matched and force transmitting manner and divide the light emission surface at the room side in the manner of transverse webs and by marginal rails which are held in the end parts and the coupling web parts and include the lateral margins of the assembly and of the components of the light emission surface at the room side as well as by further cover members.

16. A light fixture in accordance with claim 15, characterized in that the marginal rails are shaped in one part onto the light permeable plate bounding the light emission surface at the room side or onto the light guide chambers.

17. A light fixture in accordance with claim 14, characterized in that the degree of the visibility of the frame web parts at the room side can be set by the engagement depth of the frame web parts into the coupling web parts receiving them in a shape matched manner.

18. A light fixture in accordance with claim 13, characterized in that individual light fixtures are coupleable together via intermediate supports having socket holders at both sides for fluorescent lamps to provide light strip arrangements extending between two end parts, with said intermediate supports, which are connected to a mount, forming cross-webs analog to the coupling web parts of the individual modules at the light emission surface at the room side.

19. A light fixture in accordance with claim 1, characterized in that the walls of the light guide chambers and the connection wall are at least one of reflecting and/or and light scattering at least in part regions.

20. A light fixture in accordance with claim 1, characterized in that the walls of the light guide chambers and the connection wall can be combined with variably usable films, prismatic elements or partly reflecting materials.

21. A light fixture in accordance with claim 1, characterized in that prismatic surfaces are integrated into the walls of the light guide chambers and into the connection wall.

22. A light fixture in accordance with claim 11, wherein the components forming the light emission surface at the room side further include a diffuser film.

23. A light fixture in accordance with claim 1, wherein the maximum height of the light fixture in the region of the central hollow support section reduces continuously over the walls of the light guide chambers at the ceiling side in the direction of the light fixture margins approximately down to the thickness of the light permeable components forming the light emission surface at the room side.

* * * * *